United States Patent [19]

Gartner

[11] Patent Number: 4,745,784

[45] Date of Patent: May 24, 1988

[54] ELECTRONIC DIAL COMBINATION LOCK

[75] Inventor: Klaus Gartner, Palos Verdes Estates, Calif.

[73] Assignee: Alan Uyeda, Rosemead, Calif. ; a part interest

[21] Appl. No.: 854,330

[22] Filed: Apr. 21, 1986

[51] Int. Cl.[4] ..... E05B 47/00

[52] U.S. Cl. ..... 70/277; 70/278; 70/279; 70/303 A; 70/133; 70/149

[58] Field of Search ..... 70/133, 149, 277–279, 70/302, 303 A, 303 R, 333 R

[56] References Cited

U.S. PATENT DOCUMENTS

| | | | |
|---|---|---|---|
| 1,353,257 | 9/1920 | Mample | 70/278 |
| 2,079,702 | 5/1937 | Diesel | 70/303 A |
| 2,775,114 | 12/1956 | Lee | 70/133 |
| 3,045,466 | 7/1962 | Herlong | 70/133 X |
| 3,339,382 | 9/1967 | Miller et al. | 70/303 R X |
| 3,376,721 | 4/1968 | Levine | 70/277 |
| 3,559,430 | 2/1971 | Waller | 70/277 |
| 3,702,070 | 11/1972 | Gartner | 70/278 |
| 3,758,734 | 9/1973 | Gartner | 200/5 R |
| 3,968,667 | 7/1976 | Gartner | 70/303 A |
| 3,980,844 | 9/1976 | Bianco | 70/303 R X |
| 4,038,846 | 8/1977 | Klann | 70/220 |
| 4,106,316 | 8/1978 | Tippin | 70/303 A X |
| 4,148,092 | 4/1979 | Martin | 70/278 |
| 4,328,689 | 5/1982 | Keller et al. | 70/303 A |

*Primary Examiner*—Gary L. Smith
*Assistant Examiner*—Suzanne L. Dino
*Attorney, Agent, or Firm*—Poms, Smith, Lande & Rose

[57] ABSTRACT

An electronic dial combination lock has a spindle journalled within the lock for movement in two degrees of freedom, i.e., both rotational and axial displacement, to cause engagement of a push pin located on an internal cam wheel to engage one of a plurality of pressure-sensitive switches within the lock located in an evenly-spaced, circular pattern centered on the spindle's axis, each switch capable of making a discrete, unique electrical connection. Circuit means contained in the region sense the making of the electrical connections and detect when a given subset of connections has been made in a predetermined, sequential order corresponding to the lock's combination, to initiate an electrical signal within the region. The electrical signal may be used, e.g., to operate a solenoid to permit a conventional fence lever to engage the cam wheel such that a bolt within the lock may be withdrawn, such as in a safe door. The lock's internalization of all electronic circuitry renders it tamper-resistant relative to prior art electronic locks and as a suitable replacement for conventional, all-mechanical tumbler wheel locks.

20 Claims, 3 Drawing Sheets

ELECTRONIC DIAL COMBINATION LOCK

BACKGROUND OF THE INVENTION

1. Field of the Invention

This invention relates, in general, to means for initiating an electrical signal within an otherwise-inaccessible region by the manipulation of a shaft passing into the region, and in particular, to an electronic dial combination lock.

2. Description of the Related Art

There is an ongoing need for means for authorized personnel to access otherwise-inaccessible security regions easily, such as are found in safes, lock-boxes, storage rooms and the like. One such means is the well-known combination lock which typically comprises a plurality of tumbler wheels coaxially journalled on a rotating spindle which projects outwardly from the lock and is manipulated within one degree of freedom (rotational) through a predetermined, sequential series of rotations to operate a bolt within the lock. A variation on such a lock is discussed in U.S. Pat. No. 3,968,667.

With the advent of miniaturized components and digital logic circuitry, the art has seen an increasing requirement for means for producing sequential signals which may be utilized as a means for unlocking a protected region. One such sequential switch means having two degrees of movement is disclosed in my U.S. Pat. No. 3,758,734, while a second such means is illustrated in my U.S. Pat. No. 3,702,070.

An electronic combination lock which utilizes a sequential signal producing means having one degree of movement to actuate a bolt to unlock a door is disclosed in U.S. Pat. No. 4,038,846 to Klann.

These prior art devices share certain drawbacks: Some of the electronics for initiating the electrical signal are mounted externally of the protected region, and hence, are subject to a greater degree of tampering by unauthorized personnel.

A second drawback is that they are not easily adapted to retrofit existing security regions which utilize conventional, mechanical combination locks for electrical actuation.

SUMMARY OF THE INVENTION

It is therefore an object of the present invention to provide an apparatus for initiating an electrical signal within an otherwise-inaccessible region by the manipulation in two degrees of a shaft passing into the region in a predetermined, sequential order corresponding to a code or combination, in which the electronics for initiating the signal are contained entirely within the region, and which may be provided within an electronic dial combination lock for the operation of a bolt within a door providing access to the region.

It is a further object of the present invention to provide such an electronic dial combination lock that can be used to retrofit existing mechanical combination lock installations easily.

These and other objects of the present invention are preferably accomplished by the provision of a shaft having one end extending out of the security region, as well as means within the region for mounting the shaft for movement having two degrees of freedom, including means for biasing the shaft to a normally outward position relative to the region. On the external end of the shaft are means for manually-positioning the external end of the shaft at a plurality of discrete, evenly-spaced, identified angular positions, such as a dial, and for displacing the shaft axially into the region for a given distance against the shaft biasing means. On the other end of the shaft is radial arm having one end attached to the internal end of the shaft at an angular position corresponding to one of the discrete shaft angular positions, the arm having a push pin at the other end extending rearwardly and parallel to the shaft. Disposed in a planar, evenly-spaced, circular pattern perpendicular and centered on the shaft is a plurality of distinct pressure-sensitive switches which oppose the push pin such that, when the shaft is displaced axially into the region at one of the discrete, angular positions, one of the switches is contacted uniquely by the push pin to generate an electrical connection. Circuit means are contained in the region for sensing the making of the distinct electrical connections and for detecting when a given subset of the connections has been made in a predetermined, sequential order corresponding to the code or combination of the device, and further include means for generating an electrical signal, such as a voltage, upon detection of the proper code, which may be pre-set by the user. In a narrower embodiment, the signal of the preferred apparatus may be used to actuate a solenoid for the ultimate retraction of a bolt, such as in the door of a safe.

Skilled practitioners will obtain a more complete understanding of the present invention from a review of the following detailed description of a preferred embodiment, when taken in conjunction with the appended drawings, of which the following is a brief description.

DESCRIPTION OF THE PREFERRED EMBODIMENTS

Figures 1, 6, 7:
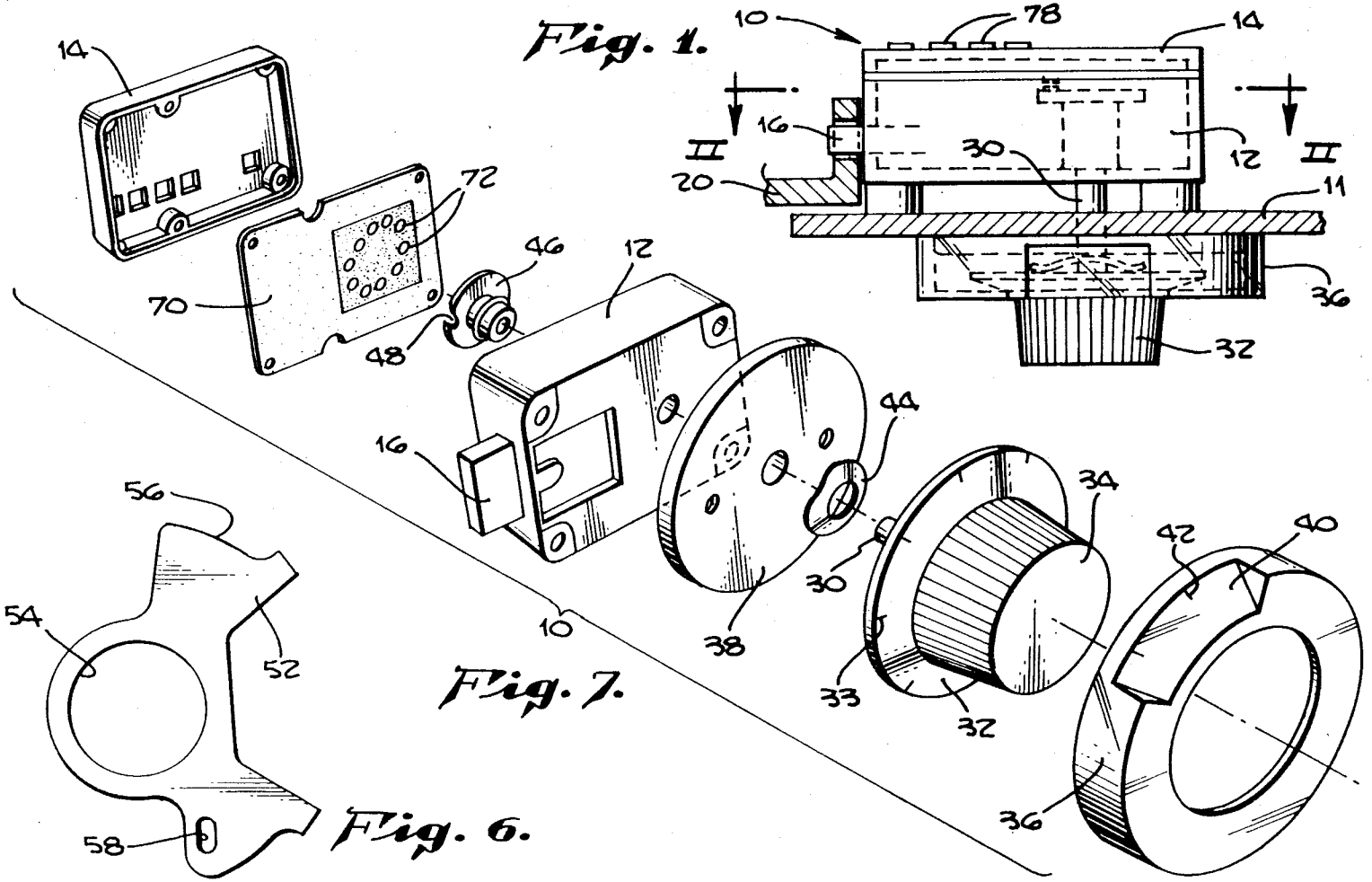
FIG. 1 is a top view of an electric combination lock in keeping with the subject of the present invention, in which section II—II is taken.
FIG. 6 is a front view of a solenoid actuating lever.
FIG. 7 is an exploded view of the lock from the front.
Figure 8:
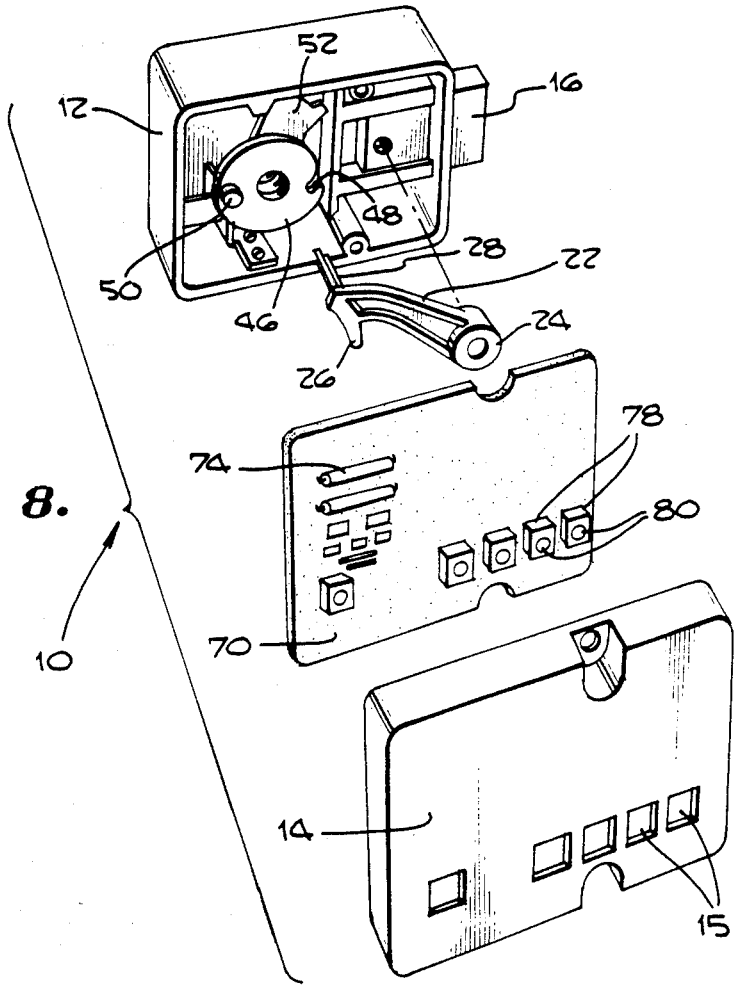
FIG. 8 is an exploded view of the lock from the rear.

An exemplary preferred electronic combination lock 10 in keeping with the present invention is illustrated in expanded form in FIGS. 7 and 8. Lock 10 preferably mounts to the inside surface of a door 11 protecting a security region, such as the contents of a safe.

Lock 10 includes a housing 12 which mounts to the rear surface of door 11 by conventional fastening means, such as screws and the bosses illustrated.

Housing 12 includes a close-fitting, rear cover 14, which provides access to the contents of housing 12 from the rear of lock 10.

Figure 2:
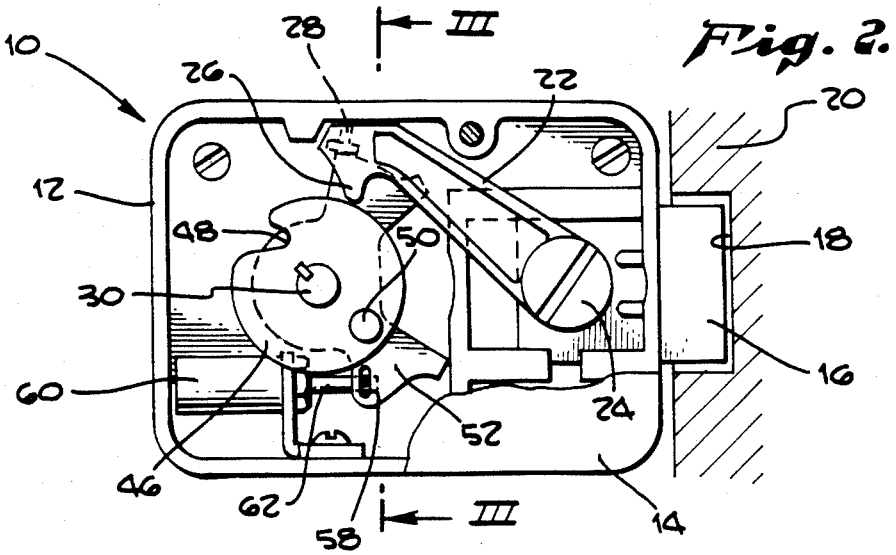
FIG. 2 is a sectional view taken into the rear of the lock, as revealed by the section II—II taken in FIG. 1.

Slidably-retained within housing 12 is a conventional bolt 16 which engages within a recess 18 contained within the wall 20 of the region protected by lock 10 (See FIGS. 1 and 2).

A fence lever 22 has one end 24 pivotally attached to bolt 16, and a second end having a nose part 26 formed thereon. A transversely-extending fence member 28 extends rearwardly of fence member 22 intermediate of the two ends.

A shaft or spindle 30 passes through the front of housing 12 and through door 11 to extend outwardly from the protected region such that an external end is accessible from outside the region, while an internal end is contained within housing 12. Shaft 30 is journalled within housing 12 for movement in two degrees, i.e., for both rotational and axial displacements relative to housing 12. Mounted to the external end of shaft 30 is a cylindrical dial 32 having a plurality of evenly-spaced radial divisions 33 marked on its circumference and a knurled knob 34 for two degree manipulation of dial 32, and hence, shaft 30.

An opaque dial ring 36 snaps over dial 32 onto mounting plate 38, which, in turn, mounts to the front surface of door 11. Dial ring 36 obscures view of the divisions 33 marked on the surface of dial 32 except for those immediately below a transparent window 40 contained in dial ring 36. Transparent window 40 additionally contains a fixed index mark 42 such that shaft 30 may be aligned at a known angular position by aligning corresponding radial division marks 33 below index mark 42. Window 40 is adapted to obscure view of the division marks 33 except from a position immediately in front of dial 34, to prevent unauthorized surveillance of manipulation of dial 34, i.e., from the side.

Biasing means 44, such as a spring, serves to bias dial 32, and hence shaft 30, to an axially-outward position relative to housing 12.

Mounted to the internal end of shaft 30 for coaxial rotation and translation therewith is a cam wheel 46. Cam wheel 46 contains a gate 48 in its circumference which is disposed to engage nose part 26 of fence lever 22 at a given angular orientation of cam wheel 46 upon rotation of shaft 30 in one direction, and to disengage nose part 26 upon rotation in the other direction.

Located on the rear surface of cam wheel 46 is a rearwardly-extending push pin 50 at an angular position corresponding to one of the discrete shaft positions and at a given radial position relative to the axis of shaft 30.

Coaxially-mounted about shaft 30 within housing 12 is a solenoid-driven, fence-lever-positioning member 52 (See FIG. 6). Positioning member 52 contains a central aperture 54 permitting it to be mounted coaxially with shaft 30 and retained in place within housing 12 by retaining rings 55. Positioning member 52 pivots about central aperture 54 between two positions, in one of which a camming surface 56 engages the fence 28 of fence lever 22 to prevent fence lever 22 from engaging cam wheel 46. In a second position, fence lever 52 is pivoted such that camming surface 56 rotates away from fence 28, thereby permitting fence lever 22 to engage cam wheel 46.

Figure 5:
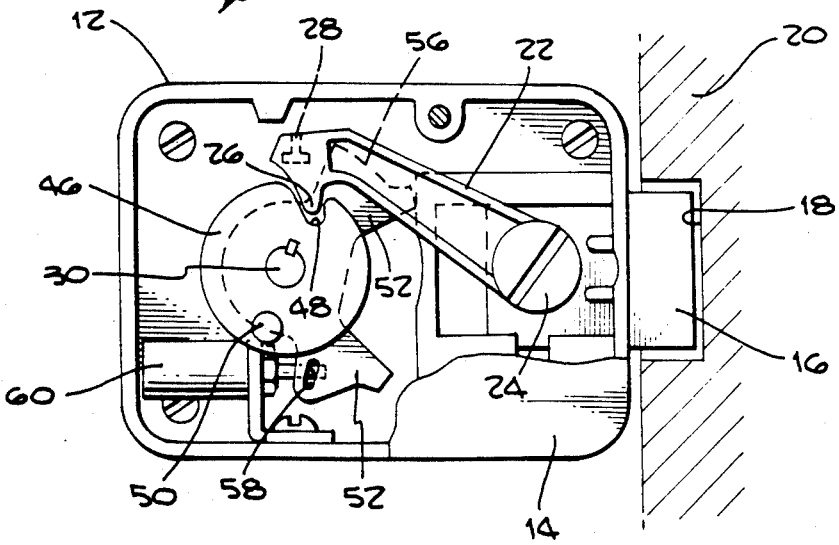
FIG. 5 is a view into the rear of the lock similar to FIG. 2 showing the lock's fence lever engaged with the lock's cam wheel.

Positioning member 52 is toggled between the two positions by means of an electrical solenoid 60 having a reciprocating armature 62 engaging an aperture 58 in positioning member 52. In the de-energized state, solenoid 60, and hence positioning member 52, assumes the first position illustrated in FIG. 2, in which camming surface 56 underlies fence 28, thereby precluding engagement of fence lever 22 with cam wheel 46. When energized, the solenoid 60, and hence positioning member 52, assume the second position illustrated in FIG. 5, in which positioning member 52 has disengaged fence 28, permitting fence lever 22 to engage nose part 26 in circumferential gate 48 of cam wheel 46. In this configuration, subsequent rotation of shaft 30 causes bolt 16 to withdraw from recess 18, thereby unlocking door 11.

Both bolt 16 and solenoid 60 are biased by spring means (not illustrated) toward the closed position, such that, upon rotation of dial 32 and spindle 30 in the opposite direction, fence lever 28 is cammed upwardly and away from cam wheel 46, whereby positioning member 52 re-engaged below fence member 28 and bolt 16 reengages recess 18.

Mounted in the rear of housing 12 in a plane generally normal to the central axis of spindle 30 and spaced apart from cam wheel push pin 50 by a given distance is a circuit component mounting board 70. Mounted thereon is a plurality of distinct, pressure-sensitive switches opposing cam wheel push pin 50 in an evenly-spaced, circular pattern centered on the axis of spindle 30 at a radial position coincident with that of push pin 50 and at angular positions corresponding to those of push pin 50 when spindle 30 is indexed at the discrete, identified angular positions. In the exemplary preferred embodiment, pressure sensitive switches 72 comprise a plurality of discrete, thin-film touch pads of a type known in the art. However, in some applications, thick-film switches or mechanical switches may be preferably substituted.

Figure 4:
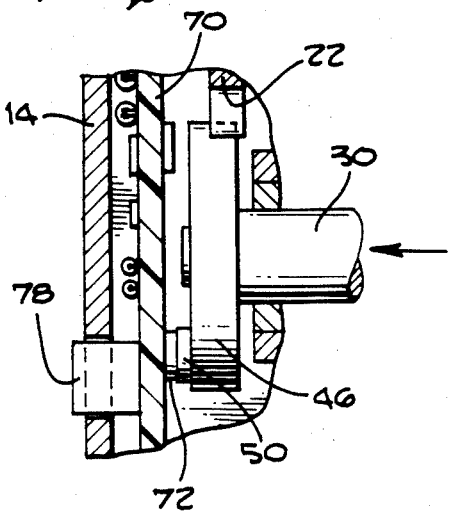
FIG. 4 is a partial, detailed section taken from FIG. 3 showing the lock's spindle displaced in the direction of the arrow.
Figure 3:
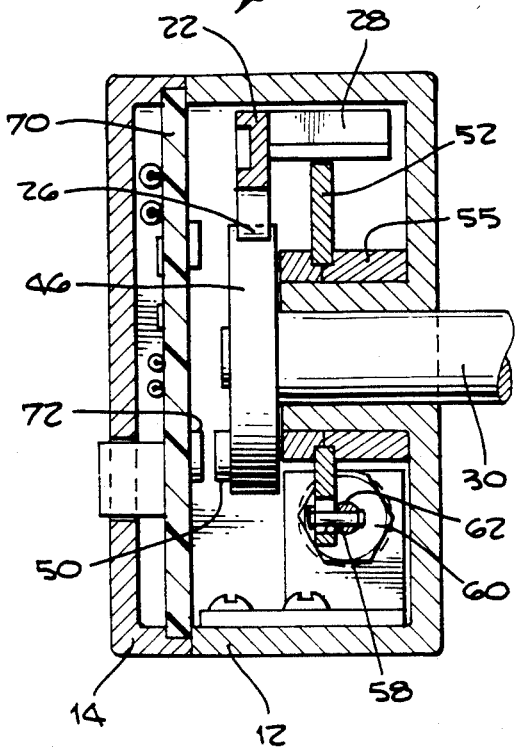
FIG. 3 is a sectional side view into the lock, as revealed by the section III—III taken in FIG. 2.

Each pressure-sensitive switch 72 is capable of making a distinct electrical connection when contacted by push pin 50, the operation of which is illustrated best in FIGS. 3 and 4. FIG. 3 illustrates shaft 30 in the outwardly-biased position. Rotation of dial 32 to an identifed angular position below index mark 42 aligns push pin 50 uniquely with one of the arrayed pressure-sensitive switches 72. If shaft 30 is then axially displaced into lock 10 by the operator at this angular position, as illustrated in FIG. 4, push pin 50 contacts its corresponding pressure-sensitive swith 72 and generates a unique electrical connection. In this regard, it may be desirable to provide means, operative when shaft 30 is pushed axially into housing 12 at any arbitrary angular position, for guiding shaft 30 into rotational alignment with the nearest of the discrete, identified angular positions, and which is otherwise inoperative upon rotation of dial 32. This preferably is accomplished by the provision of a pair of toothed wheels (not illustrated), each having teeth on opposing faces which intermesh in a plane generally normal to the axis of shaft 30, one of the wheels being mounted to the shaft, the other being axially-spaced and rotationally-fixed relative thereto, e.g., to the front of mounting ring 38, wherein the teeth are sized and disposed on the wheels such that, when shaft 30 is pushed axially into housing 12 at any given angular position, the teeth intermesh at an intermediate axial position to align shaft 30 with the division mark 33 nearest to index mark 42 when dial 34 is pressed home.

Mounting board 70 additionally provides a convenient vehicle for mounting and interconnecting with pressure-sensitive switches 72 of circuit means 74 within housing 12 for sensing the making of the electrical connections at pressure-sensitive switches 72 and for detecting when a given subset of the connections has been made in a predetermined, sequential order corresponding to the code, or combination, of the apparatus, and for generating an electrical stimulus, or signal, such as a voltage, upon the detection thereof. In the exemplary lock 10 illustrated, the electrical event initiated is a voltage to actuate solenoid 60, and circuit means 74 includes timing means for holding solenoid 60 in the open position for a period of time sufficient to permit the operator to rotate dial 32 and withdraw bolt 16 from recess 18 before solenoid 60 is de-energized.

Circuit means 74 may additionally include tamper-resistant logic, e.g., so-called "penalty" functions, i.e., those which impose consecutive delays of increasing amounts of time before solenoid 60 can be actuated upon the inputing of an improper code sequence, such as would be initiated by an unauthorized intruder attempting a the application should be limited only by the claims appended hereto.

I claim:

1. An electronic dial combination lock for initiating a signal within a closed region in said housing in response to a manually-entered code, comprising:

a slidable bolt in said housing a combination dial having an elongated member mounted in said region and having two degrees of freedom of movement and normally biased toward one of two positions within the first of said two degrees, said member having one end extending out of said region with member-positioning means located thereat for manually orienting said member at a plurality of distinct, identified orientations within the second of said two degrees and for displacing said member to the other of said two positions within said first degree at each said distinct orientation, said member having a second end contained within said region with contacting means located thereat for exerting a contacting pressure at each of a plurality of distinct, unique locations within said region when said member is displaced to said second position at each said distinct orientation; and component mounting board means located entirely within said region, including switching means arrayed at said distinct locations for making one of a plurality of distinct, unique electrical connections when contacted by said contacting means at each said location, detecting means for detecting that a given subset of said connections has been made in a predetermined, sequential order corresponding to said code, and signal generating means for generating said signal when said code subset is detected for actuating said bolt.

2. The apparatus of claim 1, wherein said first and second degrees of freedom of movement of said elongated member further comprise:

translation along, and rotation about, said member's long axis, respectively.

3. The apparatus of claim 2, wherein said member-positioning means further comprise:

a dial mounted to said first end of said member; and a dial ring fixable in opposition to said dial's circumference, one of said dial and dial ring having a plurality of radial divisions marked thereon corresponding to said plurality of distinct orientations of said member, and the other having at least one index mark thereon for movement relative to said division marks.

4. The apparatus of claim 2, wherein said member positioning means further comprises:

member-guiding means, operative when said member is displaced axially into said region at any given rotational orientation, for guiding said member into rotational alignment with said distinct orientation with which said member is most nearly aligned.

5. The apparatus of claim 4, wherein said member-guiding means further comprise:

a pair of wheels, each having teeth on opposing faces which intermesh in a plane generally normal to said member's long axis, one of said wheels being mountd to said member, the other being axially-spaced and rotationally-fixed relative thereto, said teeth being sized and disposed on said wheels such that, when said member is displaced axially into said region at any given rotational orientation, said teeth intermesh to align said member rotationally with said distinct orientation with which said member is most nearly aligned.

6. An electronic dial combination lock, comprising:

a lock housing;

a bolt slidably-retained within said housing for movement between locked and unlocked positions;

a fence lever having one end pivotally-attached to said bolt, a second end having a nose part, and a transversely-extending fence member intermediate of said ends;

a spindle having a long axis generally normal to the front of said housing, one end external of said housing, a second end contained internally of said housing, and being journaled in said housing for both rotational and axial displacement;

means for biasing said spindle to a axially-outward position from said housing;

means for manually-indexing said spindle rotationally at a plurality of discrete, evenly-spaced, identified angular positions relative to said housing and for pushing said spindle axially into said housing for a given distance against said spindle biasing means;

a cam wheel attached to said internal end of said shaft for coaxial rotation and translation therewith, said cam wheel having a circumferential gate therein disposed to engage said fence lever nose part at a given angular orientation of said cam wheel upon rotation of said spindle in one direction, and to disengage said nose part upon rotation of said spindle in the other direction, said cam wheel having a rearwardly-extending push pin located thereon at an angular position corresponding to one of said discrete spindle positions and at a given radial position relative to said spindle axis;

means for biasing said fence lever towards said cam wheel;

a solenoid having a reciprocating armature normally biased into a frst position of engagement with said fence to prevent engagement of said nose part with said cam wheel, operatively responsive to an electrical stimulus for withdrawing said armature into a second position of disengagement from said fence, to permit said nose part to engage said cam wheel;

a component mounting board mounted in said housing behind said cam wheel in a plane generally normal to said spindle axis and spaced apart from said cam wheel push pin by said given distance;

a plurality of distinct, switches mounted on said mounting board and opposing said cam wheel push pin in an evenly-spaced, circular pattern centered on said spindle axis at a radial position coincident with that of said push pin and at angular positions corresponding to those of said push pin when said spindle is indexed at said identified angular positions, each said switch making a distinct electrical connection when contacted by said push pin;

circuit means contained in said housing and connected to said switches for sensing the making of said distinct electrical connections and for detecting when a given subset of said connections has been made in a predetermined, sequential order corresponding to the combination of said lock, further including means for generating said solenoid electrical stimulus for a predetermined period of time upon detection of said subset; and power supply means for bringing external electrical power to said lock.

7. The lock of claim 6, wherein said means for indexing said spindle further comprises:

a dial mounted to said external end of said spindle; and a dial ring flixible in opposition to said dial's circumference, one of said dial and ring having a plurality of evenly-spaced radial divisions marked thereon corresponding to said plurality of discrete angular positions of said spindle and the other having at least one index mark thereon for movement relative to said divisions.

8. The lock of claim 6, wherein said means for indexing said spindle further include;

means, operative when said spindle is pushed axially into said housing at any given angular position, for guiding said spindle into rotational alignment with the nearest of said discrete angular positions, otherwise inoperative.

9. The lock of claim 7, wherein said means for indexing said spindle further include:

means, operative when said spindle is pushed axially into said housing at any given angular position, for guiding said spindle into rotational alignment with nearest of said discrete angular positions, otherwise inoperative.

10. The lock of claim 8, wherein said means for guiding said spindle further comprise:

a pair of wheels, each having teeth on opposing faces which intermesh in a plane generally normal to said spindle's axis, one of said wheels being mounted to said spindle, the other being axially-spaced and rotationally-fixed relative thereto, said teeth being sized and disposed on said wheels such that, when said spindle is pushed axially into said housing at any given angular position, said teeth intermesh to align said spindle rotationally with the nearest of said discrete angular positions.

11. The lock of claim 7, wherein said radial divisions are marked on said dial's circumference, and further comprising:

an opaque ring having a window through a portion thereof containing said index mark, said ring being fixed relative to said dial and obscuring said marked divisions on said dial except for that immediately below said index, said window being adapted to obscure view of said divisions therethrough except from a position immediately in front of said dial.

12. The lock of claim 6, wherein said combination is user pre-selectable only from within said lock.

13. The lock of claim 12, wherein said circuit means further comprises:

a plurality of adjustable, multi-positioned switches corresponding to at least the number of said electrical connections in said combination subset, each said switch having at least a number of positions corresponding to said plurality of distinct, pressure-sensitive switches, for setting said combination of said lock, said switches having an adjustment feature thereon accessible only from the rear of said lock housing.

14. The lock of claim 6, wherein:

said pressure-sensitive switches further comprise a plurality of discrete, thin-film touch pads.

15. The lock of claim 6, further comprising:

means located within said lock for temporarily supplying electrical power to said lock, operative upon termination of said external power, otherwise inoperative.

16. A kit for retrofitting a mechanical combination lock for electronic operation, comprising:

means for remounting said lock's spindle for both rotational and axial displacement, including means for biasing said spindle in an axially-outward direction;

contacting means for installation on said lock's cam wheel for exerting a pushing force in a rearward direction at each of a plurality of distinct, unique locations within said lock when said spindle is displaced axially into said lock at each of a plurality of distinct rotational orientations of said spindle;

solenoid means for replacement of said lock's tumbler wheels having armature means normally biased into a first position of engagement with said lock's fence level to prevent engagement of said lever with said cam wheel, operatively responsive to an electrical stimulus for withdrawing said armature means into a second position of disengagement from said fence lever, to permit said fence lever to engage said cam wheel;

component mounting board means for installation within said lock behind said cam wheel, said mounting board means having mounting to it circuit means, including pressure-sensitive switching means arrayed at said distinct locations for making one of a plurality of distinct, unique electrical connections when contacted by said pushing means when said spindle is displaced axially into said lock at each said distinct angular orientation, detecting means for detecting that a given subset of said connections has been made in a predetermined, sequential order corresponding to said lock's combination, and signal generating means for generating said signal when said combination subset has been detected; and power supply means for bringing power to said circuit means.

17. The kit of claim 16, wherein said pressure sensitive switching means further comprises:

a plurality of thin-film touch pads arrayed in a circular pattern on said component board mounting means and centered on said spindle's axis at radial and angular positions coincident with said pushing means when said spindle is oriented at said plurality of distinct angular positions.

18. The kit of claim 16, further comprising:

a replacement cover having a plurality of apertures therein; and wherein said circuit means further includes a plurality of adjustable, multi-positioned switches corresponding to at least the number of said electrical connections in said lock's combination subset, each said switch having an adjustment feature thereon for setting said combination of said lock positioned below one of said cover apertures and accessible therethrough from the rear of said lock.

19. The kit of claim 16, further comprising:

a pair of wheels, each having teeth on opposing faces which intermesh in a plane generally normal to said spindle's long axis, one of which is attachable to said spindle, the other being attachable to said lock in an axially-spaced and rotationally-fixed relation relative thereto, said teeth being sized and disposed on said wheels such that, when said spindle is displaced axially into said lock at any given rotational orientation, said teeth intermesh to align said spindle rotationally with said distinct, orientation with which said spindle is most nearly aligned.

20. The kit of claim 16, further comprising:

a replacement dial for mounting to said spindle having a plurality of radial divisions marked thereon corresponding to said plurality of distinct orientations of said spindle; and an opaque, relacement dial ring having a window through a portion thereof containing an index mark, said replacement ring obscuring said division marks on said replacement dial except for that immediately below said index, said window being adapted to obscure view of said division marks therethrough except from a position immediately in front of said dial.

* * * * *